US005119603A

United States Patent [19]

Jones

[11] Patent Number: 5,119,603

[45] Date of Patent: Jun. 9, 1992

[54] FIREPLACE SURROUND ASSEMBLY

[76] Inventor: Wayne J. Jones, 102 Stiles, Midlothian, Tex. 76065

[21] Appl. No.: 404,126

[22] Filed: Sep. 7, 1989

[51] Int. Cl.[5] ..... A47B 96/00; E06B 1/00

[52] U.S. Cl. ..... 52/36; 52/211

[58] Field of Search ..... 52/211, 218, 36; 126/500

[56] References Cited

U.S. PATENT DOCUMENTS

| | | | |
|---|---|---|---|
| 245,095 | 8/1881 | Scantlin . | |
| 254,868 | 3/1882 | Gudgeon . | |
| 269,536 | 12/1882 | Page . | |
| 389,340 | 9/1888 | Thompson . | |
| 409,596 | 8/1889 | Anderson . | |
| 420,775 | 2/1890 | Dambach | 52/36 |
| 591,358 | 10/1897 | Parker . | |
| 671,145 | 4/1901 | Price . | |
| 728,169 | 5/1903 | Holbein . | |
| 827,369 | 7/1906 | Holbein et al. | 52/36 |
| 1,683,168 | 9/1928 | Dambach . | |
| 4,254,596 | 3/1981 | Wright et al. | 52/36 |
| 4,727,698 | 3/1988 | Altman . | |

*Primary Examiner*—Michael Safavi
*Attorney, Agent, or Firm*—Richards, Medlock & Andrews

[57] ABSTRACT

A fireplace surround assembly (10) is provided which is capable of being adjusted vertically and horizontally to compensate for imprecisely installed fireplace assemblies and for non-standard fireplace assemblies or components. The vertical adjustment is made by moving the finished front piece (16) in relation to a center horizontal board (14). These two pieces are then affixed through the use of self-tapping fasteners inserted through slots (15) in the horizontal board (14) and into the center front piece (16). The horizontal adjustment is accomplished by moving the vertical supports (12) inward or outward before affixing them to the wall around a fireplace assembly. The mantle (18) and center cross piece (26) are both dimensioned to allow for a certain amount of lateral adjustment.

15 Claims, 2 Drawing Sheets

FIREPLACE SURROUND ASSEMBLY

TECHNICAL FIELD OF THE INVENTION

This invention generally relates to surround assemblies. In particular, this invention relates to adjustable wood fireplace surround assemblies for use around imperfectly installed fireplaces and non-standard fireplace assemblies and components.

BACKGROUND OF THE INVENTION

The brick or woodwork around the opening of a fireplace is generally referred to as a "surround." Surrounds serve both aesthetic and functional roles. For instance, the surround can include a mantel which is a useful shelf. A surround also enhances the beauty of a fireplace, creating an attractive, warm location in a family room or bedroom.

A conventional method of forming a fireplace surround involves laying in solid bricks. However, the cost of a brick surround is substantial. Furthermore, such a brick surround requires skilled masons to install. Brick surrounds are also impractical in certain situations due to their weight, the amount of time needed to construct, and the mortar's low resistance to cracking. Wood surrounds also present problems. Most prefabricated wood surrounds do not meet minimal flammability requirements. Furthermore, the installation of most wood surrounds requires additional carpentry work to both the surround and to the wall it is attached to.

Mobile homes represent a large market to the prefabricated fireplace surround manufacturer. Yet due to the speed with which mobile homes are constructed, the fireplace opening is often imprecisely cut. The fireplace assembly might be installed "out of square," or a non-standard shaped fireplace assembly with non-standard components might be used. For example, the fireplace assembly typically rests on the floor with a stone hearth in front of it. The vertical supports of the surround assembly sit on top of this hearth. Yet hearths will vary in thickness from region to region and supplier to supplier. Therefore, the different thicknesses of hearths will raise or lower the surround in relation to the fireplace assembly.

These irregularities oftentimes cannot be masked by a prefabricated, non-adjustable surround. Gaps then exist between the surround and the fireplace assembly. Such gaps greatly detract from the beauty of the fireplace. More importantly, such gaps diminish the value of the mobile home. Therefore, a need exists for a fireplace surround which can be quickly assembled and easily adjusted to compensate for imprecisely installed or non-standard and non-standard fireplace assemblies with non-standard components. Additionally, such a surround needs to meet standard flammability requirements for mobile homes and must be installable with little or no need for additional carpentry.

SUMMARY OF THE INVENTION

The present invention meets several objectives. First, it provides a fireplace surround assembly that can be easily adjusted, without the need to cut pieces, to suit imperfectly installed fireplace assemblies or fireplace assemblies of varying sizes and varying components. Second, the present invention provides a prefinished surround assembly that can be quickly assembled from relatively few components. Third, the present invention provides a surround assembly that can be installed without the need to cut any studs in the adjacent wall. Last, the present invention provides a fireplace surround which is aesthetically pleasing. In accordance with the preceding objectives, the present invention provides a fireplace surround assembly consisting of two vertical supports, an adjustable center assembly, a mantel/top, and two flashings.

When placed vertically to a wall, each vertical support presents a flat top surface partially surrounded by an L-shaped notched outer board. This outer board extends upward along the side of the vertical support farthest from the fireplace opening and along the side set against a wall. The portion of the outer board set against the wall is slightly shorter than the outer board portion along the side of the vertical support. The top surface of the outer board presents a notched surface. The back surface of the outer board also contains a groove which runs the length of the vertical support along the edge nearest the fireplace assembly.

The adjustable center assembly consists of a horizontal board and an attachable front piece. Each end of the horizontal board of the center assembly fits down securely onto the flat top surface of the vertical supports and against the inside of this L-shaped outer board. The front piece hangs from this horizontal board. The sides of the front piece rest in the vertical grooves which run the length of the vertical support. The mantel then locks securely over the top of this structure.

The vertical supports are prevented from spreading by the design of the mantel which has a cavity on its bottom capable of slipping over the tops of the vertical supports and center assembly. The mantel rests on the outer board of each vertical support. The mantel has a complimentary cleat which allows it to lock into the groove formed by the notched outer board and the wall, thereby preventing the mantel from sliding forward. The mantel is also dimensioned so as to meet flammability requirements set by Underwriter's Laboratories.

Due to the speed with which mobile homes are constructed, their fireplace assemblies are not always perfectly installed. Also, mobile homes do not all use the same thickness of hearths or fireplace assembly dimensions. To compensate for these irregularities, this invention has an adjustable center assembly for vertical adjustment and slip joints for horizontal adjustment. The adjustable center section comprises a horizontal board as well as a decorative finished front piece which hangs above the fireplace opening and below the mantel. The horizontal board extends between the vertical supports. The front piece attaches to the horizontal board by means of self-tapping screws. The screws extend through slots in the horizontal board and into the top face of the finished front piece. Due to the slots, the front piece can be adjusted vertically with respect to the horizontal board and thus adjusted with respect to the vertical supports. This adjustment does not effect the ability to place the mantel on top of the structure.

The horizontal adjustment is accomplished simply by moving the vertical supports closer together or farther apart. This does not change the appearance of the surround because the ends of the center assembly are behind the vertical supports in their vertical grooves. Furthermore, the mantel extends a greater or lesser amount beyond the outer board of the vertical supports.

Flashings are attached in the vertical groove of the vertical supports and extend from the bottom of the vertical support to the bottom of the center assembly's front piece which also sets into this groove. The flashings extend outward from the inside of the vertical support over the face of fireplace assembly. These flashings are prefinished black thin strips of metal with a slight longitudinal bend in them to allow for a pressure seal when the unit is attached to the wall around the fireplace assembly. By being black in color, they also blend with the black face of the fireplace assembly.

The foregoing and other advantages of the present invention will become readily apparent to workers skilled in the art upon consideration of the following description and reference to the appended drawings which illustrate a preferred embodiment of the invention.

BRIEF DESCRIPTION OF THE DRAWINGS

For a more complete understanding of the present invention and for further details and advantages thereof, reference is now made to the following Detailed Description taken in conjunction with the accompanying drawings, in which.

DETAILED DESCRIPTION

Figure 1:
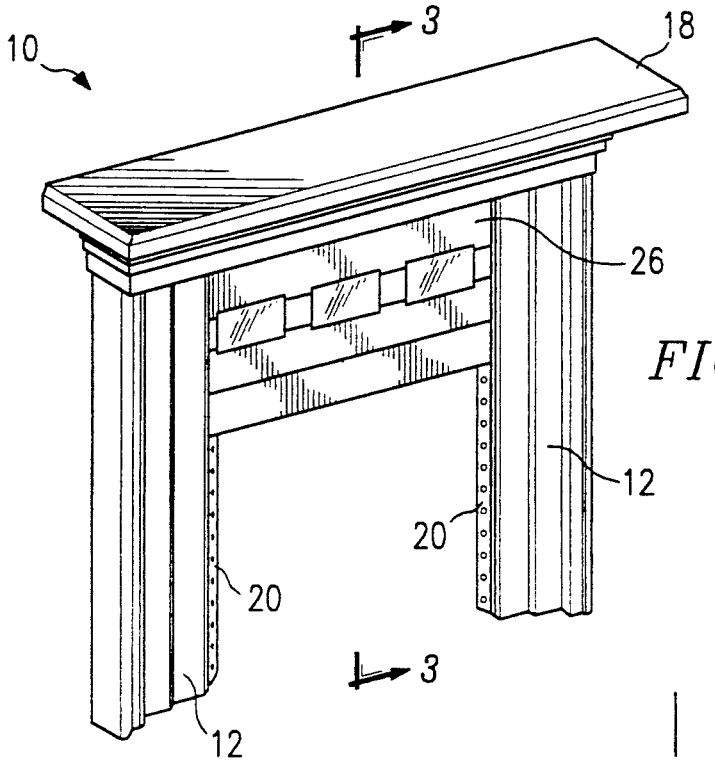
FIG. 1 is a perspective view of the assembled fireplace surround.
Figure 2:
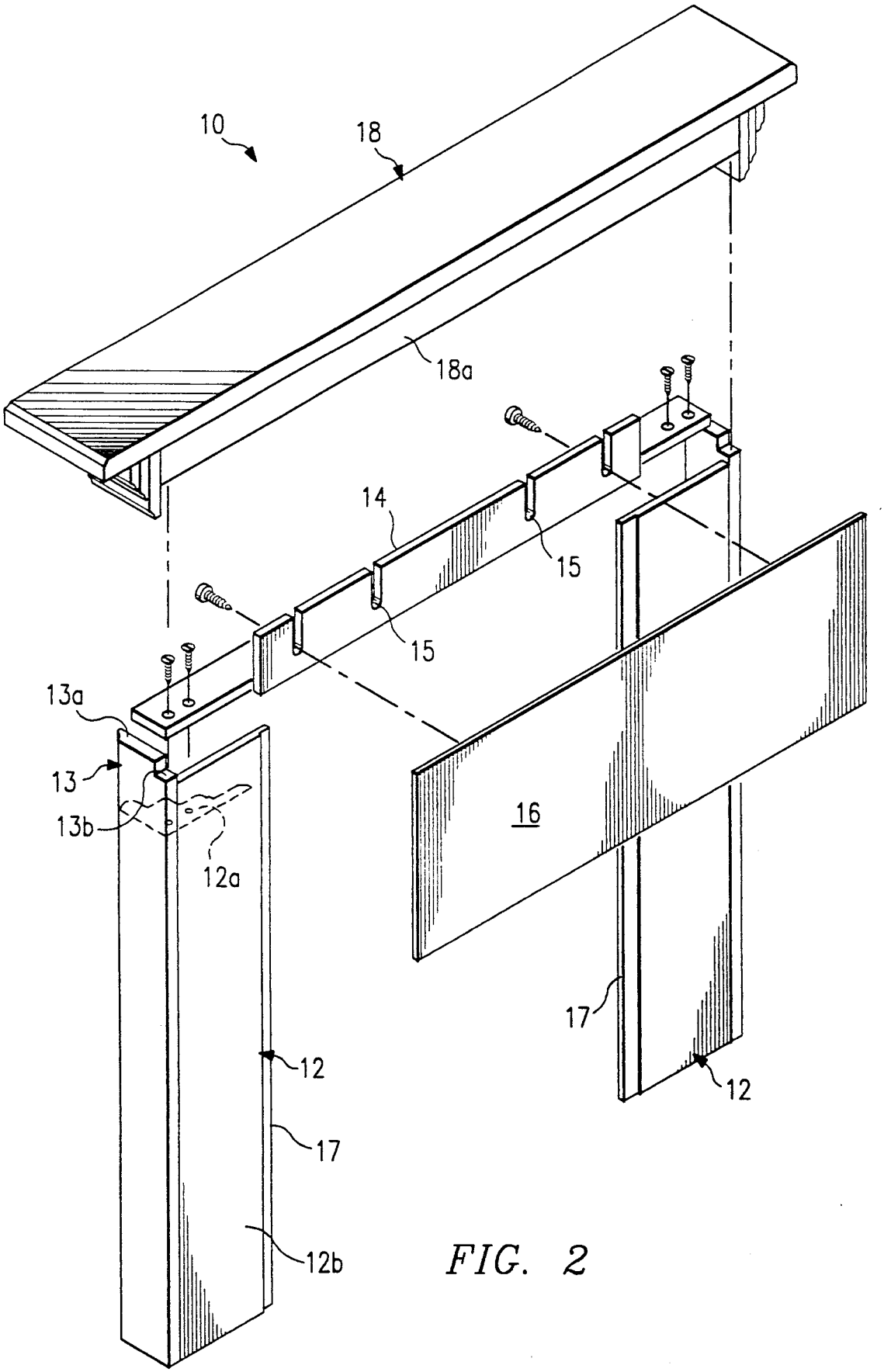
FIG. 2 is an exploded view of the surround assembly from the rear.

Referring simultaneously to FIG. 1 and FIG. 2, a fireplace surround 10 embodying the present invention is disclosed. Supports 12, which are generally vertically mounted on a wall around a fireplace assembly, are separated by a center assembly 26. Flashings 20 line the inside of the vertical supports 12 in grooves 17. The flashings 20 are attached to vertical supports 12 by suitable attachment means. The mantel 18 locks on top of the vertical supports 12 and center assembly 26.

FIG. 2 shows an exploded view of the fireplace surround assembly 10. Each support 12 is typically comprised of a primary structure 12*a* with a back surface, a side surface, and an upper surface or top end. A back board 12*b* is attached to the back surface of the primary structure 12*a*. An outer board 13 is attached to the side surface of the primary structure 12*a*. The top end of each vertical support 12 presents a flat surface. The back board 12*b* is taller than the primary structure 12*a*. The outer board 13 has a notched upper surface. The unnotched portion 13*b* of said upper surface is longer than the back board 12*b*. The notched portion 13*a* of said upper surface is the same length as and is adjacent to the back board, thereby forming a channel adjacent the wall. Center assembly 26 attaches to the top end of the vertical supports 12. The center assembly 26 consists of a center front piece 16 supported by the horizontal board piece 14. The horizontal board 14 has several slots 15 along its length. Self-taping fasteners are preinstalled through the slots on piece 14 and into piece 16, making pieces 14 and 16 one adjustable center assembly 26. The slots 15 allow for adjustment in the relative vertical positioning of the front piece 16 to horizontal board 14 and hence vertical adjustment relative to the vertical supports 12. Lateral adjustment is obtained by moving vertical supports 12 in or out from each other.

A mantel 18 locks on top of the vertical supports 12 and center assembly 26. The mantel 18 locks into the notched outer board 13 of vertical support 12 and extends over the front of the horizontal board 14 of center assembly 26. Black flashings 20 are attached on the inside lengths of the vertical supports 12 in vertical notch 17 creating a pressure seal against the face of the fireplace assembly, blending in with the black face of the fireplace assembly.

The ends of the center front piece 16 can fit into vertical grooves 17. Therefore, the front piece 16 of the center assembly 26 will be flush with the front plane of the fireplace assembly when the front piece 16 of the center assembly 26 is inset into the wall by 5/16" (thickness of wall covering used). The fireplace assembly face extends 5/16" beyond the face side of the wall covering. Hence, insetting the front piece 16 the depth of the wall covering eliminates any major carpentry work when installing surround assembly, i.e., cutting of vertical studs.

Figure 3:
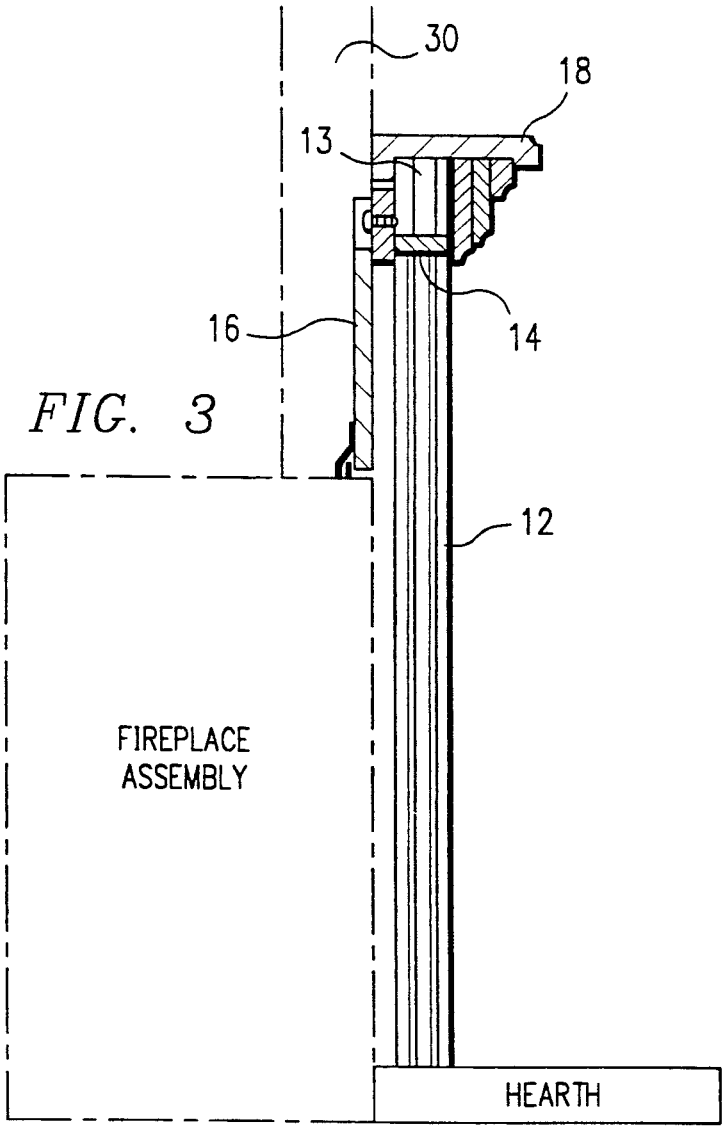
FIG. 3 is a cross-sectional view along line 3—3 as shown in FIG. 1.

FIG. 3 shows a cross-sectional view along line 3—3 as shown in FIG. 1. This affords a better view of the notched outer board 13. The notched outer board 13 fits against the wall. The notched portion 13*a* is located on the corner of outer board 13 immediately adjacent the wall 30. The cleat 18*a* extends beneath the mantel 18 along the side of the mantel 18 adjacent the wall 30. The cleat 18*a* is as wide and as deep as the notched portion 13*a*. Therefore, the mantel 18 may be set on the vertical supports 12 so that the cleat 18*a* fits within the channel formed by outer board notch 13*a* and the wall. Also note that vertical support 12 sits on top of the hearth. The center front piece 16 is shown inset slightly into the wall.

Although preferred embodiments of the invention have been described in the foregoing Detailed Description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications, and substitutions of parts and elements as fall within the spirit and scope of the invention.

I claim:

1. An apparats for surrounding the opening of a fireplace assembly comprising:

(a) a pair of supports positioned apart from each other with an upper surface and an inside length portion, wherein said upper surface comprises a flat surface, with an L-shaped outer board extending above two of the sides of the vertical support, leaving a central flat surface, said L-shaped outer board extending above the upper surface of the support higher on one side than on the other side;

(b) a horizontal board with a plurality of slots therethrough removably attached to the upper portion of said supports;

(c) a front piece adjustably attached to said horizontal board;

(d) a mantel engaging the top surface of said vertical supports; and (e) a pair of flashings removably attached to the inside lengths of said supports.

2. The apparatus of claim 1 wherein each of said supports comprises a structural member mounted to extend along a wall means on opposite sides of the fireplace assembly, each of said supports having a vertical groove extending the length of the support and located on an edge mounted against the wall.

3. The apparatus of claim 1 wherein said horizontal board comprises a structural member having two ends and surface means on each end capable of complementing the flat portion of the upper surface of said supports.

4. The apparatus of claim 1, wherein said mantel further comprises a structural member capable of extending between the two supports with the horizontal board extending therebetween, capable of engaging the top of the supports by resting on said L-shaped outer board of the supports and further capable of maintaining engaging with the top of such structure after lateral adjustment of the supports.

5. The apparatus of claim 1, wherein said front piece comprises a rectangular board capable of hanging from the horizontal board by attachment means.

6. The apparatus of claim 1, wherein said front piece further comprises a rectangular finished piece of wood which can hang by removable attachment means from the horizontal board down to the top of the fireplace opening, and hang behind said supports in a vertical groove located on the inside length portion of each support.

7. The apparatus of claim 5, wherein attachment means comprises a fastener which extends through holes in the front piece and through a plurality of slots in the horizontal board, said slots allowing for the front piece to be fixed to the horizontal board at a multitude of relative angles.

8. The apparatus of claim 1, wherein said flanges comprise strips of metal with a longitudinal bend capable of being mounted to the inside length portion of the vertical supports, creating a pressure seal between the vertical supports and the fireplace assembly.

9. An apparatus for surrounding an opening in a fireplace assembly which is mounted flush to a wall, said apparatus comprising:

(a) two support members attached to said wall, wherein each of said support members comprises:
  (i) a primary structure with a back surface, a side surface, and an upper surface;
  (ii) a back board attached between the back surface of said primary structure and the wall, said back board further comprising a vertical groove; and
  (iii) an outer board attached to the side surface of said primary structure;
(b) a board attached between said support members wherein said board contains a slotted central portion;
(c) a front piece vertically adjustably attached to said board;
(d) a mantel with a bottom surface complementary to the upper surface of the support members; and
(e) two flashings, each flashing attached to the vertical groove in said back board.

10. The apparatus of claim 9 wherein said back board is longer than said primary structure.

11. The apparatus of claim 9 wherein said outer board has a notched upper surface, said outer board being longer than said back board.

12. The apparatus of claim 9 wherein said board is attached to the upper surface of said primary structure.

13. The apparatus of claim 9 wherein said front piece is adjustably attached to the board by fastener means inserted through the slots in said board.

14. The apparatus of claim 9 wherein said front piece sets in the vertical grooves of the back board when the board is attached to the supports.

15. The apparatus of claim 11 wherein the bottom surface of said mantel presents a cleat which complements the channel formed by the back board, the side board and the wall.

* * * * *